US008726650B2

(12) United States Patent
Kotsonis et al.

(10) Patent No.: US 8,726,650 B2
(45) Date of Patent: May 20, 2014

(54) HYDRAULIC MANIFOLD PUMP

(75) Inventors: Spyro Kotsonis, Missouri City, TX (US); Gilles Cantin, Verrieres le Buisson (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 1031 days.

(21) Appl. No.: 12/744,345

(22) PCT Filed: Nov. 17, 2008

(86) PCT No.: PCT/EP2008/009698

§ 371 (c)(1),
(2), (4) Date: Sep. 2, 2010

(87) PCT Pub. No.: WO2009/065537

PCT Pub. Date: May 28, 2009

(65) Prior Publication Data

US 2011/0185717 A1 Aug. 4, 2011

(30) Foreign Application Priority Data

Nov. 23, 2007 (GB) ..... 0722931.3

(51) Int. Cl.
*F15B 7/00* (2006.01)

(52) U.S. Cl.
USPC ..... 60/476; 60/475

(58) Field of Classification Search
USPC ..... 60/473, 475, 476
See application file for complete search history.

(56) References Cited

U.S. PATENT DOCUMENTS

| | | | | |
|---|---|---|---|---|
| 3,877,347 | A | 4/1975 | Sheesley et al. | |
| 3,903,698 | A | 9/1975 | Gellatly et al. | |
| 4,343,153 | A * | 8/1982 | Kern et al. | 60/460 |
| 5,444,979 | A * | 8/1995 | Funami et al. | 60/460 |
| 5,575,150 | A * | 11/1996 | Vieten et al. | 60/476 |
| 5,778,671 | A * | 7/1998 | Bloomquist et al. | 60/456 |
| 6,273,770 | B1 | 8/2001 | Saito | |
| 7,254,945 | B1 * | 8/2007 | Sakai et al. | 60/476 |
| 2001/0022083 | A1 | 9/2001 | Muschong et al. | |
| 2006/0168955 | A1 * | 8/2006 | Longfield et al. | 60/473 |
| 2006/0168956 | A1 | 8/2006 | Sakai et al. | |
| 2007/0095060 | A1 | 5/2007 | Kurz et al. | |

FOREIGN PATENT DOCUMENTS

| | | |
|---|---|---|
| EP | 0314660 | 5/1989 |
| WO | 2007122652 | 11/2007 |

* cited by examiner

*Primary Examiner* — Thomas E Lazo
(74) *Attorney, Agent, or Firm* — Stephanie Chi; Jody DeStefanis

(57) ABSTRACT

A hydraulic manifold pump comprising a housing in which is located a first hydraulic circuit and a second hydraulic circuit. A bidirectional motor connectable to the first hydraulic circuit and the second hydraulic circuit, the bidirectional motor being able to activate the first hydraulic circuit when operable in a first direction, and being able to activate the second hydraulic circuit when operable in a second direction. The hydraulic manifold pump further compromises a hydraulic actuator having two hydraulic chambers being connectable to the first hydraulic circuit and to the second hydraulic circuit, and both the first and second hydraulic circuits being connected to and able to vent into a fluid reservoir.

12 Claims, 4 Drawing Sheets

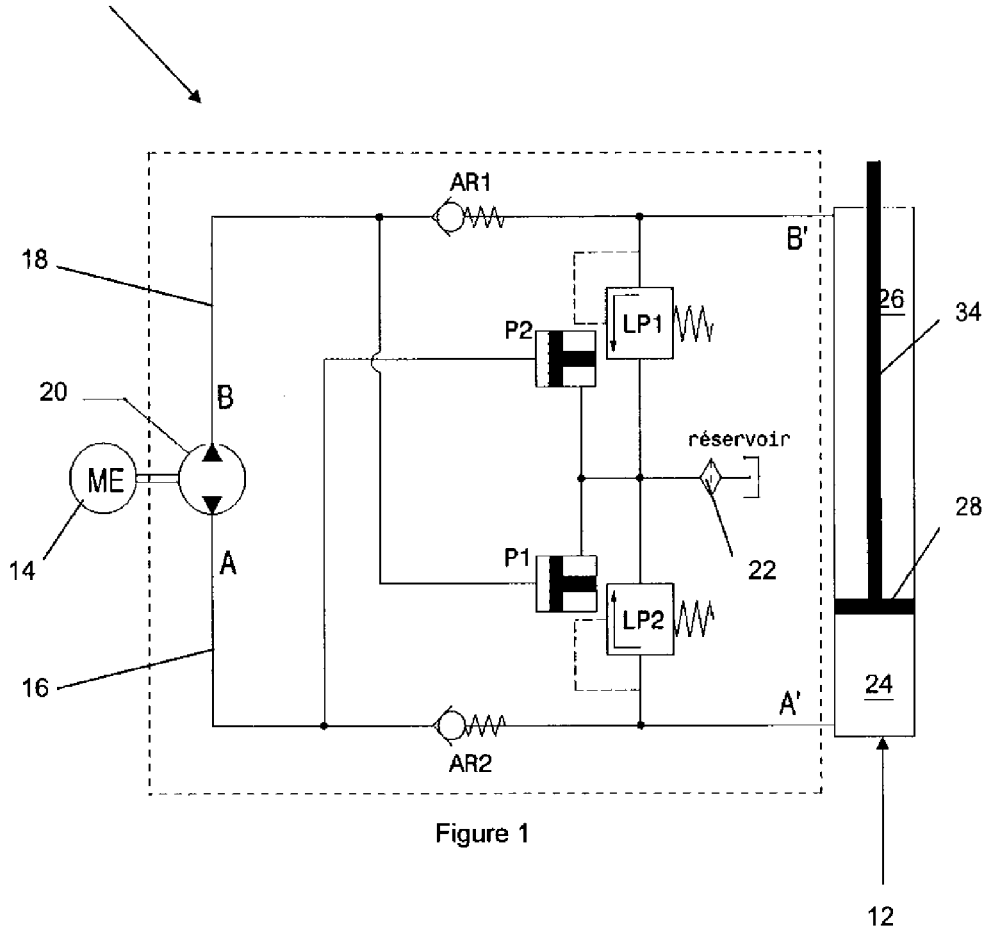
Figure 1
Figure 2a
11
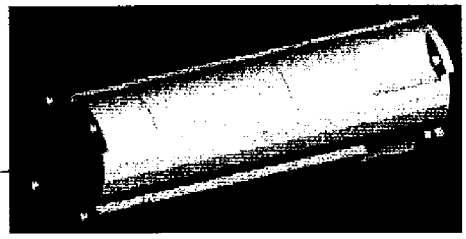
Figure 2b
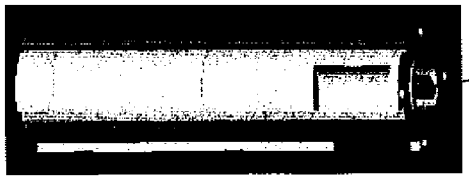
15

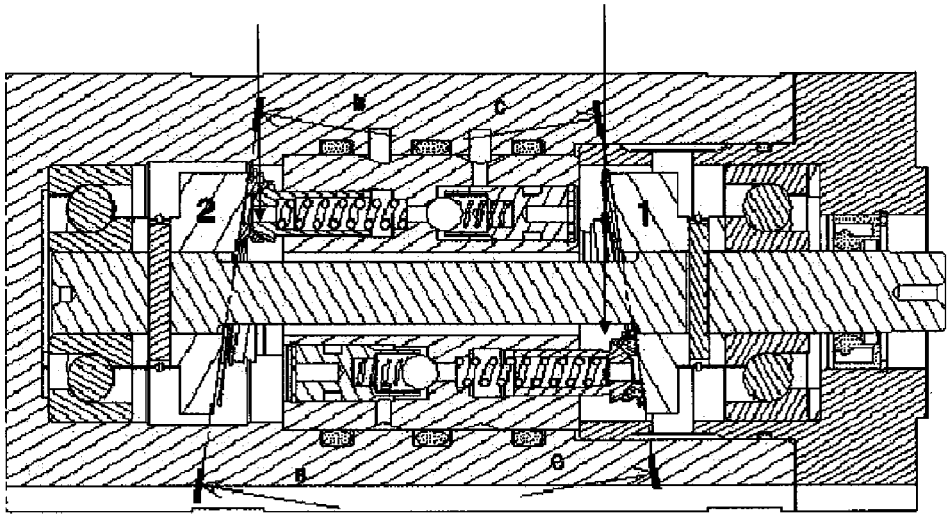
11 Figure 3 15

HYDRAULIC MANIFOLD PUMP

CROSS-REFERENCE TO RELATED APPLICATIONS

The present application is based on and claims priority to GB Application No. 0722931.3, filed 23 Nov. 2007; and International Patent Application No. PCT/EP2008/009698, filed 17 Nov. 2008. The entire contents of each are herein incorporated by reference.

TECHNICAL FIELD

This invention relates to a hydraulic manifold pump. More particularly, the invention relates to a hydraulic manifold pump which may be used to drive a mechanical system in a well.

BACKGROUND ART

Conventional hydraulic systems that are used to drive mechanical systems in down-hole applications in wells, such as oil or gas wells, mainly employ two or more hydraulic solenoid valves to orient the flow in the hydraulic lines. These conventional systems, however, do not have a very good reliability due to oil pollution and/or internal leaks. In addition, the hydraulic oil flow rate can be poor through the solenoid valves used in wireline tools due to the small passageways used in these systems. This poor rate of flow increases the time that it takes the hydraulic systems to drive the mechanical systems in the well.

In typical wireline tools which use hydraulic circuits to move a mechanical system, one of the important factors that affects the success of the job is the time spent activating the hydraulic system. Frequent changes in position, and the setting and retracting of hydraulic pistons in such a system lead to an increase in the drilling time that is lost during the completion of these procedures.

The simplicity or complexity of the hydraulic systems used in a well is a factor of reliability as well. This invention discloses a hydraulic manifold pump that can set and retract a piston in an actuator by hydraulic means using a 2-way flow of hydraulic fluid, without the use of solenoid valves. One of the advantages of the current invention is that the hydraulic flow mechanisms are more simple, and thus more efficient and reliable. This simplicity results in the minimum amount of drilling time lost as a result of the activation of the hydraulic system.

In addition, using a faster hydraulic system to drive the kinematics in a wireline tool offers many advantages in terms of the reduction in cost-of-logging. This is accomplished by less drilling time being lost when the hydraulic mechanism is set and retracted, and by a reduction in the electrical power needed to run the tool as the tool needs fewer electrical components in order to drive the hydraulic high pressure portion of the pump system and thus also needs less electricity in order to function.

DISCLOSURE OF INVENTION

A first aspect of the invention provides a hydraulic manifold pump comprising:

- a housing in which is located a first hydraulic circuit and a second hydraulic circuit;
- a bidirectional motor being connectable to the first hydraulic circuit and the second hydraulic circuit;

- the bidirectional motor being able to activate the first hydraulic circuit when the motor is operated in a first direction, and being able to activate the second hydraulic circuit when the motor is operated in a second direction;
- a hydraulic actuator being connectable to the first hydraulic circuit and to the second hydraulic circuit, the hydraulic actuator having two hydraulic chambers; and
- both the first and second hydraulic circuits being connected to and able to vent into a fluid reservoir.

Preferably the bidirectional motor controls the fluid flow rate in the first hydraulic circuit and in the second hydraulic circuit. Typically the motor is an electric motor and the rotational speed produced by the motor controls the fluid flow rate.

In one form of the invention the first hydraulic circuit is connected to a first hydraulic chamber of the hydraulic actuator, and the second hydraulic circuit is connected to a second hydraulic chamber of the hydraulic actuator.

The bidirectional motor is preferably connectable to the first hydraulic circuit and the second hydraulic circuit via a bidirectional pump mechanism.

Each of the first and second hydraulic circuits may include at least a non-return valve, a pressure limiting valve and a relief valve.

Preferably both the first hydraulic circuit and the second hydraulic circuit are closed hydraulic circuits. The flow of hydraulic fluid through both the first and second hydraulic circuits may be regulated by the valves in each circuit and the fluid may vent into the fluid reservoir when the fluid flows in a first direction through each circuit, and the fluid may be drawn out of the reservoir when the fluid flows in a second direction through each circuit.

The bidirectional motor is preferably an electric motor.

A second aspect of the invention provides a method of hydraulically activating a mechanical system by means of a hydraulic manifold pump according to the first aspect of the invention, the method comprising:

- pumping a hydraulic fluid through a first hydraulic circuit by means of a bidirectional motor acting in a first direction via a bidirectional pump mechanism;
- pumping a hydraulic fluid through a second hydraulic circuit by means of a bidirectional motor acting in a second direction via the bidirectional pump mechanism;
- regulating the fluid flow through the first hydraulic circuit from the bidirectional pump to a first chamber of an actuator, by means of valves and the use of a fluid reservoir;
- regulating the fluid flow through the second hydraulic circuit from the bidirectional pump to a second chamber of an actuator, by means of valves and the use of the fluid reservoir;
- venting fluid into the fluid reservoir during the activation of the first hydraulic circuit in a first direction, and drawing fluid from the reservoir during the activation of the first hydraulic circuit in a second direction; and
- venting fluid into the fluid reservoir during the activation of the second hydraulic circuit in a first direction and drawing fluid from the reservoir during the activation of the second hydraulic circuit in a second direction.

Preferably the valves in each of the first and second hydraulic circuits may include at least a non-return valve, a pressure limiting valve and a relief valve.

BRIEF DESCRIPTION OF FIGURES IN THE DRAWINGS

FIG. 1 shows a schematic diagram of the fluid flow system in a hydraulic manifold pump, attached to a hydraulic actuator, according to one embodiment of the invention;

FIG. 2*a* shows a schematic isometric side view of the manifold pump from the actuator connection side, according to the invention;

FIG. 2*b* shows a schematic isometric side view of the manifold pump from the electrical motor connection side, according to the invention;

FIG. 3 shows a schematic sectional side view though the manifold pump mechanism according to the invention;

Figure 4:
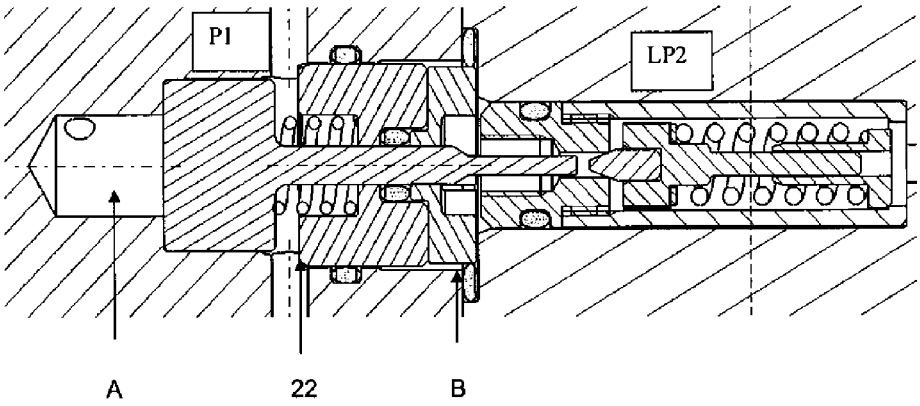
FIG. 4 shows a schematic sectional side view through a pilot valve and a relief valve of the hydraulic manifold pump according to the invention.
Figure 5:
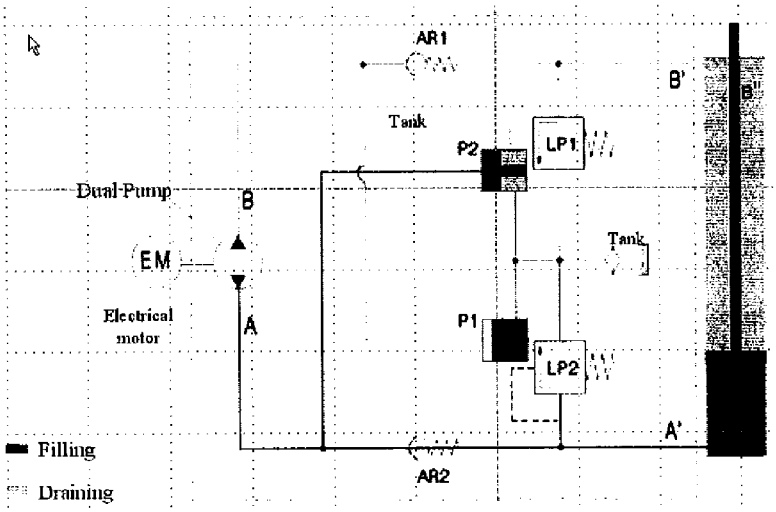
Figure 6:
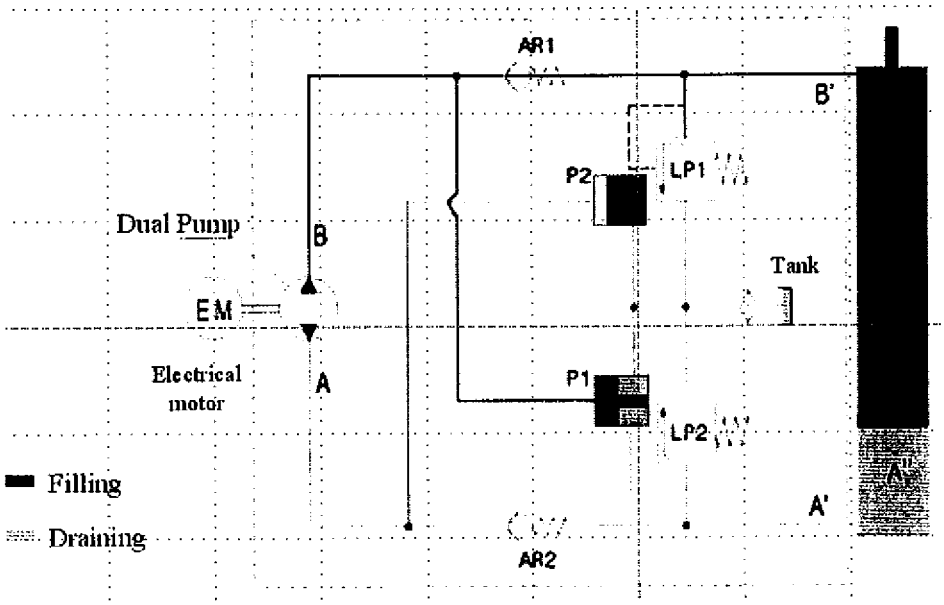

FIG. 5 shows the schematic representation of the fluid flow system in the hydraulic manifold pump of FIG. 1, in which the activation of the fluid flow through the first hydraulic circuit is highlighted; and FIG. 6 shows the schematic representation of the fluid flow system in the hydraulic manifold pump of FIG. 1, in which the activation of the fluid flow through the second hydraulic circuit is highlighted.

MODE(S) FOR CARRYING OUT THE INVENTION

A preferred embodiment of this invention is illustrated in FIGS. 1 to 6. FIG. 1 shows a schematic diagram of a hydraulic manifold pump 10, according to one embodiment of the invention, which is connected to a double acting hydraulic actuator 12 on one side 11, and an electrical motor 14 on the other side 15. Hydraulic manifold pump 10 is also shown in FIGS. 2*a*, 2*b* and 3, and includes a first hydraulic circuit 16 and a second hydraulic circuit 18, both of which are attached to a bidirectional pump mechanism 20 and an internal fluid reservoir 22. Electric motor 14 is a bidirectional motor which produces a rotational speed that controls the fluid flow rate in the first and second hydraulic circuits 16, 18.

The first hydraulic circuit 16 is indicated using the letter "A" and the second hydraulic circuit 18 is indicated using the letter "B" in FIGS. 1, 5 and 6.

Hydraulic actuator 12 has two hydraulic chambers 24 and 26, which are connected to manifold pump 10 and separated from each other by a piston 28. Chamber 24 is connected to first hydraulic circuit 16 of manifold pump 10 and chamber 26 is connected to second hydraulic circuit 18.

Manifold pump 10 is a bidirectional pump with an integrated flow manifold incorporating first and second hydraulic circuits 16 and 18, respectively, driven by electric motor 14, which is capable of turning in both directions, clockwise and counter clockwise. Electric motor 14 drives the bidirectional pump mechanism 20 in one direction to activate hydraulic circuit 16, and in the other direction to activate hydraulic circuit 18. Electric motor 14 also controls the rate of the fluid flow through each of the hydraulic circuits 16, 18 by changing the speed of rotation that it produces.

The bidirectional functionality of the manifold pump 10 is physically obtained by the use of the two axially placed hydraulic circuits 16 and 18 being packaged into one block, as shown in FIG. 3. In FIG. 3 the hydraulic manifold pump 10 of the preferred embodiment is shown to include a swash plate 1 and 2, one for each of the first and second hydraulic circuits 16 (A), 18 (B). For the angled flat on swash plate 1, circuit 16 (A), the fluid enters through the port indicated by the letter "c" and is pressurized to exit through the port indicated by the letter "C" (not shown on the illustrated plane). Similarly, for swash plate 2 circuit 18 (B), the fluid enters through the port indicated by letter "b" and exits through the port indicated by the letter "B".

In this embodiment, the single inner shaft shown in FIG. 3 has swash plates 1 and 2 attached rotationally to it, and the pistons shown in FIG. 3 are fixed to the pump housing. As the shaft, and therefore the swash plates 1 and 2, are rotated by the electric motor 14, the pistons either send pressurized fluid to one of the circuits 16, 18 or simply circulate the fluid in manifold pump 10 and produce no work.

As illustrated in FIGS. 1, 5 and 6, the fluid flow system through manifold pump 10 is from A to A' and B to B' output pressure ports. These output pressure ports A' and B' are then each connected to chambers 24 (A") and 26 (B"), respectively in actuator 12.

The first hydraulic fluid circuit 16 and the second hydraulic fluid circuit 18 each use a pilot valve, namely P1 and P2, respectively, a relief valve, namely LP1 and LP2, respectively, and a check valve AR1 and AR2, respectively. Pressure line A of hydraulic circuit 16 connects the relief valve LP2 and the piloted valve P2, which then drives the relief valve LP1. Pressure line B of hydraulic circuit 18 connects the relief valve LP1 and the piloted valve P1, which then drives the relief valve LP2.

To fill chamber 24 (A") in actuator 12, manifold pump 10 is activated by electrical motor 14 in a counter clockwise direction, to pump fluid through the first circuit 16 side. Fluid from bidirectional pump mechanism 20 flows along pressure line A of the first circuit 16, and feeds pilot valve P2 and chamber 24 (A") via the check valve AR2. Chamber 26 (B") of actuator 12 is sealed by the check valve AR1 and the pressure limiter relief valve LP1, and thus the piston shaft 34 of actuator 12 does not move. The pressure of the fluid in pressure line A of the first circuit 16 then increases and reaches the activation pressure of pilot valve P2, which in turn activates the relief valve LP1 and thus connects chamber 26 (B") to the internal reservoir 22. No o-ring seal is used between pilot valve P2 and the housing of manifold pump 10, to allow the decompression of the fluid in pressure line A of first circuit 16, and thus also the closure of the relief valve LP1. Pilot valve P2 is lapped with the housing seat of manifold pump 10 to minimize the leak rate. Decompression only occurs between the bidirectional pump 20 and the check valve AR2, the sealing of the chamber 24 occurring via by the check valve AR2 and the relief valve LP2. The piston 28 of actuator 12 then moves from chamber 24 to chamber 26. Once the fluid pressure in line A decreases, it causes relief valve LP1 to close, and thus the bidirectional pump 20's rotation can be inverted to obtain a fluid flow in pressure line B of second circuit 18.

To fill the chamber 26 (B") in actuator 12, the bidirectional pump 20 is activated by electrical motor 14 being activated in the clockwise direction, to pump the fluid through the second circuit 18 side of manifold pump 10. Fluid flows along the pressure line B, and feeds pilot valve P1 and chamber 26 (B") via the check valve AR1. Because chamber 24 of actuator 12 is sealed by means of check valve AR2 and the pressure limiter relief valve LP2, the piston shaft 34 and piston 28 of actuator 20 do not move. The fluid pressure in pressure line B then increases and reaches the activation pressure of pilot valve P1, which in turn activates the relief valve LP2 and thus connects chamber 24 to reservoir 22. No o-ring seal is used between the pilot valve P1 and the housing of the manifold pump 10 in order to allow the decompression of the fluid in pressure line B and thus the closure of the relief valve LP2. The pilot valve P1 is lapped with the housing seat of manifold pump 10 in order to minimize the leak rate. Decompression only occurs between bidirectional pump 20 and the check valve AR1, the sealing of chamber 26 occurring via by the check valve AR1 and the relief valve LP1. Piston 28 of actuator 12 then moves from chamber 26 to chamber 24. Once the fluid pressure of pressure line B decreases, it causes relief valve LP1 to close and bidirectional pump 20's rotation can be inverted to again obtain a fluid flow in line A of first circuit 16.

Manifold pump 10 finds particular application in the activation of mechanical systems used in down-hole wells, such as oil or gas wells, particularly with those used with typical wireline tools.

While the present invention has been described with respect to a limited number of embodiments, those skilled in the art having the benefit of this disclosure, will appreciate numerous modifications and variations therefrom. It is intended that the appended claims cover all such modifications and variations as fall within the true spirit and scope of this present invention.

What is claimed is:

1. A hydraulic manifold pump comprising:

a housing having a first hydraulic circuit and a second hydraulic circuit, wherein the first hydraulic circuit comprises a first check valve, a first pilot valve, and a first relief valve and the second hydraulic circuit comprises a second check valve, a second pilot valve, and a second relief valve, and wherein both the first and second hydraulic circuits are connected to a fluid reservoir for venting;

a bidirectional motor connectable to the first hydraulic circuit and the second hydraulic circuit;

a hydraulic actuator connectable to the first hydraulic circuit and to the second hydraulic circuit, the hydraulic actuator having a first hydraulic chamber and a second hydraulic chamber; and the bidirectional motor capable of activating the first hydraulic circuit when the motor is operated in a first direction, and capable of activating the second hydraulic circuit when the motor is operated in a second direction;

wherein when the first hydraulic circuit is operated in the first direction, a first fluid portion flows through the first check valve to the first hydraulic chamber and a second fluid portion flows to the second pilot valve, wherein the second pilot valve is configured to activate the first relief valve at a first activation pressure.

2. The hydraulic manifold pump as claimed in claim 1, wherein the bidirectional motor controls the fluid flow rate in the first hydraulic circuit and in the second hydraulic circuit.

3. The hydraulic manifold pump as claimed in claim 2, wherein the motor is an electric motor and the rotational speed produced by the electric motor controls the fluid flow rate.

4. The hydraulic manifold pump as claimed in claim 1, wherein the first hydraulic circuit is connected to a first hydraulic chamber of the hydraulic actuator, and the second hydraulic circuit is connected to a second hydraulic chamber of the hydraulic actuator.

5. The hydraulic manifold pump as claimed in claim 1, wherein the bidirectional motor is connectable to the first hydraulic circuit and the second hydraulic circuit via a bidirectional pump mechanism.

6. The hydraulic manifold pump as claimed in claim 1, wherein both the first hydraulic circuit and the second hydraulic circuit are closed hydraulic circuits.

7. The hydraulic manifold pump as claimed in claim 1, wherein the flow of hydraulic fluid through both the first and second hydraulic circuits is regulated by the respective check valves, pilot valves, and relief valves in each circuit and the fluid vents into the fluid reservoir when the fluid flows in a first direction through each circuit, and the fluid is drawn out of the reservoir when the fluid flows in a second direction through each circuit.

8. The hydraulic manifold pump as claimed in claim 1, wherein the bidirectional motor is an electric motor.

9. A method of hydraulically activating a mechanical system by means of a hydraulic manifold pump as claimed in claim 1, the method comprising:

pumping a hydraulic fluid through a first hydraulic circuit by means of a bidirectional motor acting in a first direction via a bidirectional pump mechanism;

pumping a hydraulic fluid through a second hydraulic circuit by means of a bidirectional motor acting in a second direction via the bidirectional pump mechanism;

regulating the fluid flow through the first hydraulic circuit from the bidirectional pump to a first chamber of an actuator, by means of a first check valve, a second pilot valve, a first relief valve, and the use of a fluid reservoir;

regulating the fluid flow through the second hydraulic circuit from the bidirectional pump to a second chamber of an actuator, by means of a second check valve, a first pilot valve, a second relief valve, and the use of the fluid reservoir;

venting fluid into the fluid reservoir during the activation of fluid flow in a first direction through the first hydraulic circuit, and drawing fluid from the reservoir during the activation of the fluid flow in a second direction through the first hydraulic circuit; and venting fluid into the fluid reservoir during the activation of fluid flow in a first direction through the second hydraulic circuit, and drawing fluid from the reservoir during the activation of the fluid flow in a second direction through the second hydraulic circuit.

10. The hydraulic manifold pump of claim 1, wherein when the second hydraulic circuit is operated in the second direction, a third fluid portion flows through the second check valve to the second hydraulic chamber and a fourth fluid portion flows to the first pilot valve, wherein the first pilot valve is configured to activate the second relieve valve at a second activation pressure.

11. The hydraulic manifold pump of claim 1, wherein the housing is configured such that fluid from the second hydraulic chamber vents into the fluid reservoir when the first relief valve is activated.

12. The hydraulic manifold pump of claim 1, wherein the housing is configured such that fluid from the first hydraulic chamber vents into the fluid reservoir when the second relief valve is activated.

* * * * *